US005870870A

United States Patent [19]

Utzman

[11] Patent Number: 5,870,870

[45] Date of Patent: Feb. 16, 1999

[54] SHEAR PANEL JOINT

[76] Inventor: Charles H. Utzman, 133 Eldridge, Mill Valley, Calif. 94941

[21] Appl. No.: 854,026

[22] Filed: May 9, 1997

Related U.S. Application Data

[60] Provisional application No. 60/017,741 May 15, 1996.

[51] Int. Cl.[6] ..... E04B 2/30

[52] U.S. Cl. ..... 52/483.1; 52/479; 52/745.21; 52/765; 52/796.1; 411/451; 411/455

[58] Field of Search ..... 52/483.1, 479, 52/765, 796.1; 411/451, 455, 456, 487, 922

[56] References Cited

U.S. PATENT DOCUMENTS

| | | | |
|---|---|---|---|
| 2,111,110 | 3/1938 | Deniston, Jr. et al. | 52/483.1 |
| 2,172,553 | 9/1939 | Tripp | 411/455 |
| 2,307,348 | 1/1943 | Anderson | 411/487 |
| 4,016,697 | 4/1977 | Ericson | 52/796.1 |
| 4,359,849 | 11/1982 | Goeman | 52/479 |
| 4,590,733 | 5/1986 | Schneller et al. | 52/483.1 X |
| 5,377,461 | 1/1995 | DeGrada et al. | 52/448.31 X |
| 5,391,029 | 2/1995 | Fardell | 411/451 |
| 5,492,452 | 2/1996 | Kirsch et al. | 411/455 |

FOREIGN PATENT DOCUMENTS

| | | | |
|---|---|---|---|
| 657685 | 3/1938 | Germany | 411/451 |

*Primary Examiner*—Christopher Kent
*Assistant Examiner*—Timothy B. Kang

[57] ABSTRACT

A shear resistant structural panel assembly for use in framed buildings comprising a facing of finish material bonded and having a lower tensile strength to a usually thinner, structural membrane having a higher tensile strength and directly fastened to structural framing elements by a series of shouldered fasteners applied through the shear panel along both its edges and within the field of the panel, said fasteners securing said structural membrane to the face of the structural framing elements at the bearing face of the shoulder to resist shearing and separation forces on said assembly. The preferred embodiment is a nail with a cone shaped ridge located below the surface of the nail's head at a depth sufficient to pin the sheet metal to the supporting structural frame. The bevel indents the sheet metal providing a broad bearing surface sa as to increase the tearout strength as well as preventing the sheet metal from lifting free of the framing element. Under cycled loading conditions the fastener provides a highly ductile joint which absorbs energy and dampens building oscillations reducing the loads on the building's structure.

23 Claims, 5 Drawing Sheets

SHEAR PANEL JOINT

This application is a continuation of copending Provisional Application No. 60/017,741, filed May 15, 1996 and claims priority under 35 U.S.C. 119(e) based thereon.

BACKGROUND OF THE INVENTION

This invention relates to metal shear panel fasteners, specifically nails and screws used to fasten shear resistant diaphragms to framing elements in the construction of framed buildings and the like and to joints and structures created therewith.

All buildings require shear resistant structural elements in order to resist lateral forces produced by winds and earthquakes. In general, there are three types of structural systems used in framed buildings to resist lateral shear forces: moment resistant frames, diagonal bracing, and shear resistant diaphragms. A typical shear wall assembly consists of three structural elements: a frame bounds the shear panel and provides intermediate elements to inhibit panel buckling and increase tensile and compressive strength; shear panels are applied over the frame to provide shear resistance; and a fastening system which connects the shear membrane to the frame elements.

Typically shear panels are constructed from sheets of plywood or Oriented Strand Board (OSB), thin sheet steel, or other composite materials (such as reinforced plastics) applied to wood or steel studs or joists by means of nails or screws. These panels are then usually covered with sheets of Gypsum Wall Board (GWB) or some other finish materials to provide a cosmetically attractive surface. When the anticipated loads are low enough the Gypsum Wall Board has sometimes been used by itself to provide the structural membrane.

Until recently, the laboratory structural testing used to certify the strength of shear resisting systems has employed a gradually applied, one directional, load (so called monotonic loading). However, as more experience with failures in actual earthquake conditions has been acquired, monotonic certification has come into question. Brittle materials have been determined to perform poorly under cyclical, shock loading conditions. Pending the development of more realistic testing methodology the allowable strengths of GWB has been halved in the Uniform Building Code.

The use of GWB, plywood, or OSB for shear walls pose structural problems for design engineers and installers:

(a) Plywood and OSB have a lack of uniformity in strength due to variations in wood properties and manufacturing processes. Variations i n construction conditions such as overdriven nails and exposure to moisture also reduce the strength of assembled shear walls.

(b) GWB panels are very brittle and the paper covering has very little tearthrough strength. Under cycled loading conditions the screws or nails pull though the face paper and the gypsum surrounding the fasteners fractures at relatively low loads.

(c) The hardened steel screws sometimes used as fasteners also perform poorly compared to nails when used with high strength membranes such as plywood. The hardening process reduces ductility and the threads introduce stress concentrations. Under cyclical loading conditions the screws fatigue and fail near the surface of the framing elements.

In 1977, U.S. Gypsum was granted U.S. Pat. No. 4,016,697 for gypsum wall board clad with sheet steel on one face for use in buildings. That patent shows the attachment of the composite panel to the framing elements by means of conventional screws, nails, and clips. The patent discusses the use of the panels as bending or compression elements but makes no mention of shear capability. Recently a structural panel identical to U. S. Gypsum's patented system has been marketed by Cemco for use as a shear panel in steel framed buildings. Cemco's panel consists of a sheet of GWB bonded to a sheet of either 22 gauge or 25 gauge sheet metal. This panel is designed to be screwed to a steel frame and eliminates the need for a separate lateral bracing system. Panels of the foregoing type suffer from structural limitations under conditions of earthquake loading due their employment of conventional fasteners. Under cycled loading conditions the screws' heads tend to pull through the paper facing of the GWB under the influence of out-of-plane loads. When the structural membrane begins to lift free of the face of the studs the resulting increased bending load on the screws, combined with the screw's fatigue problem, result in a premature structural failure. Nails could be substituted for the screws but the tear-through problem remains. Screws could be driven completely through the gypsum wall board so as to bear directly on the steel but the fatigue problem remains and inspection is difficult. Both nails and screws provide limited bearing area to resist tearout/bearing failure in thin structural membranes. At present there is no fastener available that fully utilizes the structural capabilities of thin, shear membranes. Conventional screws and nails as well as specialty fasteners were not designed for, nor are they suitable, for this application:

So called "duplex" nails are used in concrete form work to facilitate the subsequent reuse of wooden forming materials. Such fasteners, described in U.S. Pat. No. 451,213 to Shepley, are double headed nails to be used for the temporary erection of wood. These fasteners are not intended to be driven deeper than their lowermost head so that the upper head is readily accessible for later extraction of the form nail. Duplex nails provide no greater bearing area in shear than standard nails, are not available in appropriate head configurations for this application, and lack the proper relationship between the head's locations so as to be self gauging during installation.

So called "ring-shanked" nails are used to provided increased resistance to nail withdrawal in wood flooring systems. Such fasteners are described in U.S. Pat. No. 2,172,553 to Tripp. The annular ridges of such fasteners are of a constant diameter and would produce an unsuitably oversized hole in the structural membrane and weakening the shear and uplift strength of the connection.

A specialty nail for the installation of plaster rock of lathing disclosed in U.S. Pat. No. 2,633,049 to Anderson has a moveable head and a conical projection on the shank intended to be driven completely through the rock layer and into the wood stud to create an oversized hole in the rock and allow subsequent movement of the rock lath. Such a fastener would produce serious structural damage to a structural membrane and would create a weak attachment.

A specialty nail for attaching metal lathing to wood studs disclosed in U.S. Pat. No. 383,951 to Hegbom in 1888 has a protrusion of the nail shaft for the purpose of supporting the lath. The nail's shoulder is located well clear of the surface of the stud and would provide no structural advantage over a standard nail in this application.

If a water resistant, fire resistant, GWB panel with a structural membrane backing were provided with an easily installed and inspected fastening system which took full advantage of the strength and ductility characteristics of the structural membrane, the supporting frame, and the fastener then a marked advance in the art of framed building construction would ensue.

The improved shear resistant panel assembly forming the subject of this invention is best accomplished by a novel panel of water and fire resistant GWB bonded to a layer of galvanized sheet metal said panel attached to the framing elements by shouldered fasteners which pin the sheet metal directly to the face of the frame. The structural backing can also be thickened along the panel edges to increase its resistance to fastener tearout under high loads. The structural backing can also be constructed of other materials such as fiber reinforced resins. The GWB layer can also be replaced by other finish materials such as wood or plastic.

SUMMARY OF THE INVENTION

This invention relates to shear panels comprised of a membrane relatively strong in tensile strength and an adjacent layer of lower tensile strength material for cosmetic and/or other purposes and particularly to securing such shear panels to the face of a frame or other structure for reinforcing the shear strength of the structure. In accordance with this invention such shear panels are secured to the structure, with the membrane adjacent the face thereof, by fasteners comprising a shaft having a shoulder intermediate a head at one end thereof and a point at the other. The shoulder of the fastener desirably extends around the shaft in an annular or ring configuration. The shoulder has a bearing surface at the side thereof remote from the head for engaging the membrane when the point end of the fastener is driven through the panel from the lower tensile strength material side and into the underlying frame or other structure. Preferably the bearing surface is annular and concentric with the shaft. The bearing surface desirably extends outwardly of the shaft about the shaft's longitudinal axis a distance of at least 10% of the diameter of the shaft adjacent thereto toward the point end and preferably a distance in the range of 25% to 200% of the diameter of the shaft adjacent thereto toward the point end.

Desirably, the distance along the shaft between the top of the head of the fastener and the bearing surface of the shoulder is at least about equal to or greater than the distance through the panel from the surface at the lower tensile strength material side to the surface of the higher tensile strength membrane, so that the head of fastener may be easily driven, by a hammer, screwdriver or the like, from the lower tensile strength material side of the panel to drive the shaft into the panel to a depth that the bearing surface of the shoulder engages the membrane. Advantageously, the distance along the shaft between the top of the head of the fastener and the bearing surface of the shoulder is about equal to the distance through the panel from the surface at the lower tensile strength material side to the surface of the membrane so that fastener installation is "self-gauging." That is, when the fastener is driven into the panel to a depth where the head thereof is flush with or slightly below the surface, the bearing surface of its shoulder engages the membrane but has not completely penetrated through and beyond the membrane. In the case of shear membranes with GWB as the low tensile strength layer, it is the practice to "dimple" the fasteners, i.e. drive them to a slightly "subflush" position where the top of the fastener head is a short distance below the surface of the sheet to insure that a smooth surface is obtained. The dimensions of the fastener, and particularly the distance between the head and the bearing surface of the shoulder, will be sized in accordance with the foregoing in the case of GWB to take into account the subflush positioning of the fastener head due to dimpling.

In a further aspect of this invention, the bearing face of the shoulder of the fastener extends outwardly from the shaft at an angle in the longitudinal direction of the shaft toward the head, preferably with a generally frusto-conical configuration to serve as a wedge to expand the hole in the membrane, when driven partially therethrough, and to remain seated in the expanded hole to thereby increase the tear-out strength of the resulting connection with the membrane. Desirably, the distance along the shaft from the top of the fastener head to a selected seating location along the bearing face is equal to distance through the panel from the surface at the lower tensile strength material side to the surface of the membrane, so that the bearing face of the shoulder wedges out the hole and remains seated in the expanded hole when the fastener has been to driven to bring the head flush with or slightly below the surface of the panel.

In another feature of the invention, the head of the fastener shaft is provided with a rim or skirt having a diameter substantially greater than the shank between the head and the bearing face of the shoulder. The rim of the head engages the surface of the lower tensile strength material side when the fastener is driven to resist bending forces acting against the nail shank at the shoulder bearing surface when the panel is subjected to shear forces. For the same purpose, in another feature of the invention the shaft above the bearing face of the shoulder has a diameter substantially greater than the diameter of the shaft therebelow and desirably a diameter up to that of the shoulder, so that when the fastener is driven the surrounding wall of the low tensile strength layer will be immediately adjacent the enlarged shaft to impede bending of the shaft when the panel is subjected to shear. Desirably for this purpose the diameter of the upper shaft is at least two thirds of the diameter of the largest diameter of the shoulder and preferably equal to the largest diameter of the shoulder.

OBJECTS AND ADVANTAGES

Accordingly, besides the objects and advantages of the shear panel fastener described in my above patent, several objects and advantages of the present invention are:

a] to provide a fastener which bears directly on the structural membrane to increase tear-through strength b] to provide a fastener bearing face close to the framing element so as to reduce fastener bending stresses c] to provide a fastener bearing face close to the framing element so as to reduce fastener withdrawal loads d] to provide ductile fastener e] To provide a fastener that can be rapidly installed using a pneumatically actuated nail gun or electrically operated screw gun f] to provide an increased bearing area in the structural membrane to increase its lateral load capacity and energy capacity e] to provide increased joint ductility and energy absorption so as to reduce building loads by hysteretic damping f] to provide a self gauging means of fastener installation and inspection g] to allow the use of a smaller diameter lower portion of the shaft for the fastener so as to reduce splitting in wooden framing elements when large numbers of fasteners are required for high load conditions Other objects and advantages are to provide an easily installed and inspected fastener, which is inexpensive to manufacture, which takes maximum advantage of the strength of the structural membrane, which greatly increases the hysteretic damping of the fastener joints, and which is highly resistant to failure under cycled loading conditions.

BRIEF DESCRIPTION OF THE DRAWINGS

FIG. 2A shows a shear wall joint assembly of the preferred embodiment consisting of a nail with a conical shoulder attaching a steel backed GWB shear panel to a wood frame.

FIG. 2B shows a joint assembly in which the steel structural membrane has a reinforced edge.

FIG. 2C shows a joint assembly in which the steel structural membrane has a reinforced edge.

FIG. 2D shows a joint assembly in which the frame elements consist of a stud or joist made of composite material.

FIG. 2E shows a joint assembly in which the frame elements consist of hollow steel studs or joists and the fastener has a screw thread.

FIG. 3A shows a nail with a conical shoulder.

FIG. 3B shows a nail with a radiused shoulder.

FIG. 3C shows a nail with a shoulder with a serrated face.

FIG. 3D shows a nail with a shoulder with brad points.

FIG. 3E shows a nail with a shoulder with a annular pointed ring.

DETAILED DESCRIPTION OF THE PREFERRED EMBODIMENT

Figure 1:
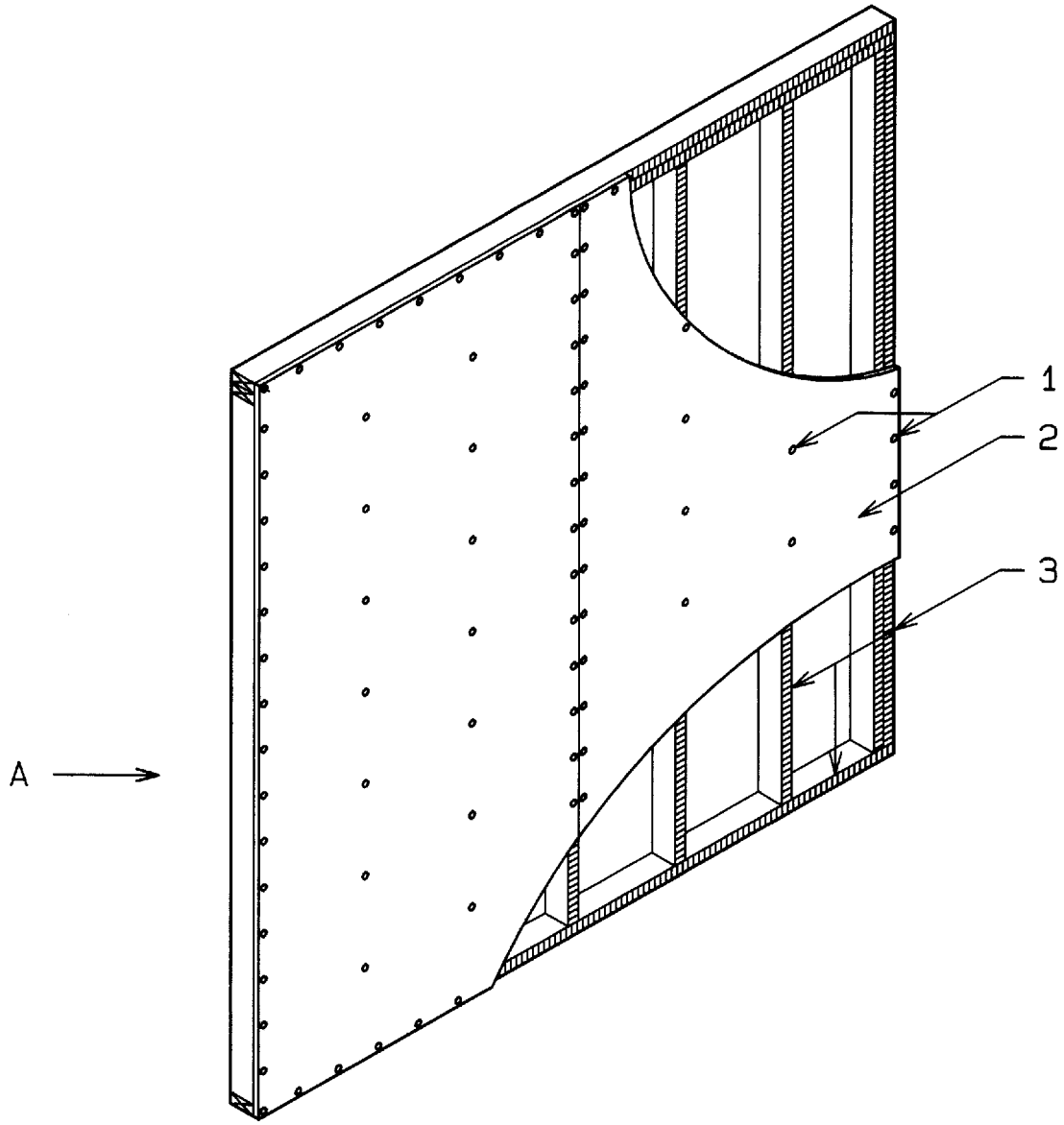
FIG. 1 shows a typical shear wall assembly of the present invention.

A typical embodiment of the shear wall assemblies of the present invention is illustrated in FIG. 1 wherein a typical shear wall assembly A consisting of shear panels 2 attached to the structural framing members 3 by a series of shouldered fasteners 1, as will be described. In this embodiment shear panels 2 may comprise as a higher tensile strength membrane layer that is preferably a 26 gauge steel sheet in contact with the framing members and an adjacent lower tensile strength layer at the side of the membrane layer opposed to the framing members that is preferably a one half inch thick GWB sheet that will serve as both as a finished layer for the panel and as an insulator, etc.

Another important embodiment of the shear wall assemblies of this invention is a unitary "sandwich" or "stressed-skin" panel composed of two opposed panels in face to face relationship with framing elements therebetween, usually at opposed sides of the panels, to support and space the panels. Such sandwich panels may take the form of a wall assembly A as shown in FIG. 1, but having panels 2 as described above on both the front side of framing members 3, as shown in FIG. 1, and on the reverse side of the framing members. Both such panels 2 will have their respective membrane layers adjacent framing members 3 and their respective lower tensile strength layers at the side of their respective membrane layer opposed to the framing members and each panel will be joined to the framing members 3 by shouldered fasteners 1, as will be described. These stressed-skin panels may advantageously be mounted horizontally in floor and roof applications, where the bending strength of the panel is developed by tensile and compressive loading of the opposed panels created by the transfer of shear forces through the joints of this invention.

A typical embodiment of the joints of the present invention which may be employed in the shear wall assembly of FIG. 1 and other constructions is illustrated in FIG. 2A through 2D. In each of these figures the panel shown comprises a membrane 9 with an adjacent finish layer 10 of uniform thickness that is attached to the framing member 3 by a fastener 1 comprising a shaft having an upper shaft portion 8 and a lower shaft portion 5 with a point 6 at the end thereof, a head 4, and a beveled shoulder 6A between the upper and lower portions of the shaft having a bearing surface 7. The fastener 1 is installed so that its head 4 is dimpled subflush with the surface of finish layer 10. At this depth of installation the beveled shoulder bearing surface or face 7 has formed a beveled penetration in the membrane 9 with the shoulder bearing surface 7 pinning the membrane tightly to the framing member 3. As can be seen the seating contact of the shoulder bearing surface 7 occurs over at a seating location along surface 7 in the axial direction of the shaft intermediate its upper and lower ends of surface 7. When fastener 1 is driven, shoulder 6A will create a hole through finished layer 10 having the maximum diameter of the shoulder. However, the rim 4A on head 5 extends axially outwardly of shaft portion 8 and of shoulder 6A and thus beyond the hole created thereby, so that rim 4A is able to engage the surface of layer 10 beyond the hole.

Figure 2B:
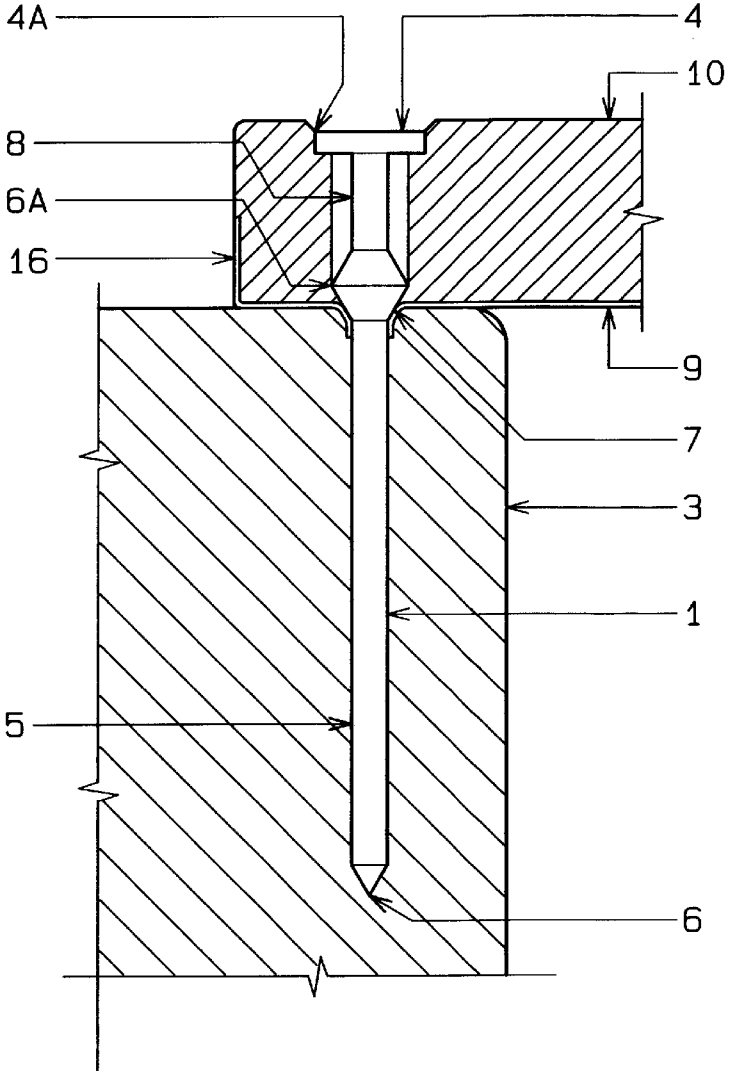
FIGS. 2A through 2E illustrate the shear panel joint attachment in accordance with this invention of various shear panel configurations to various types of framing with various types of shouldered fasteners as follows.
Figure 2A:
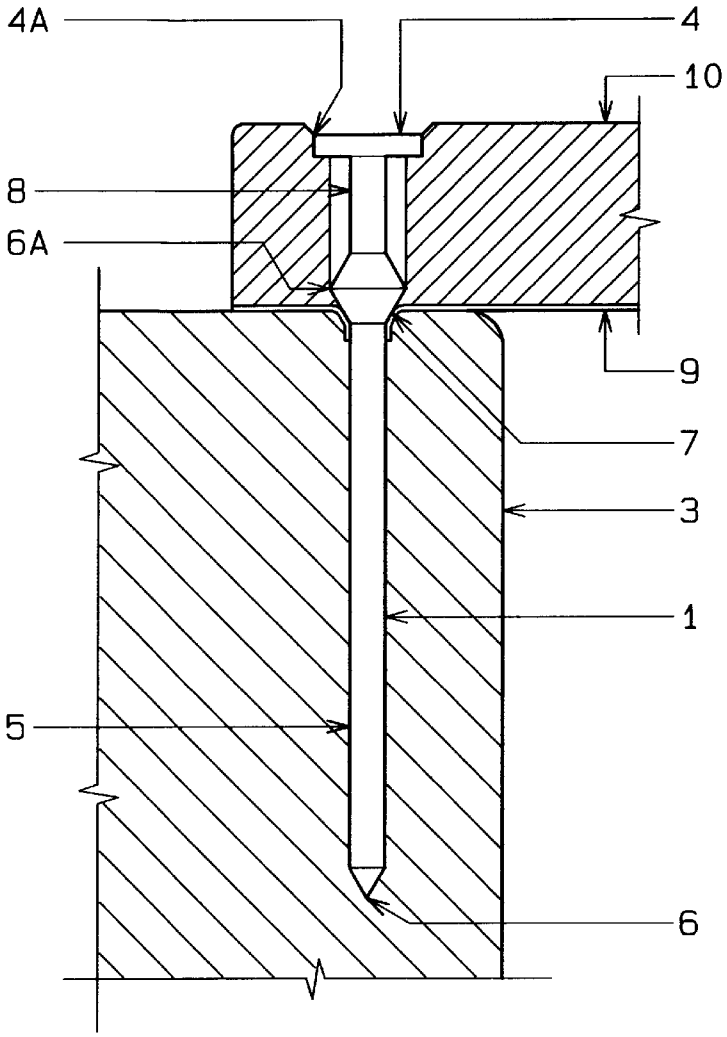

In FIGS. 2B the membrane 9 is turned up along the edge 16 of the panel so as to reinforce the panel's tearout strength and ductility.

Figure 2D:
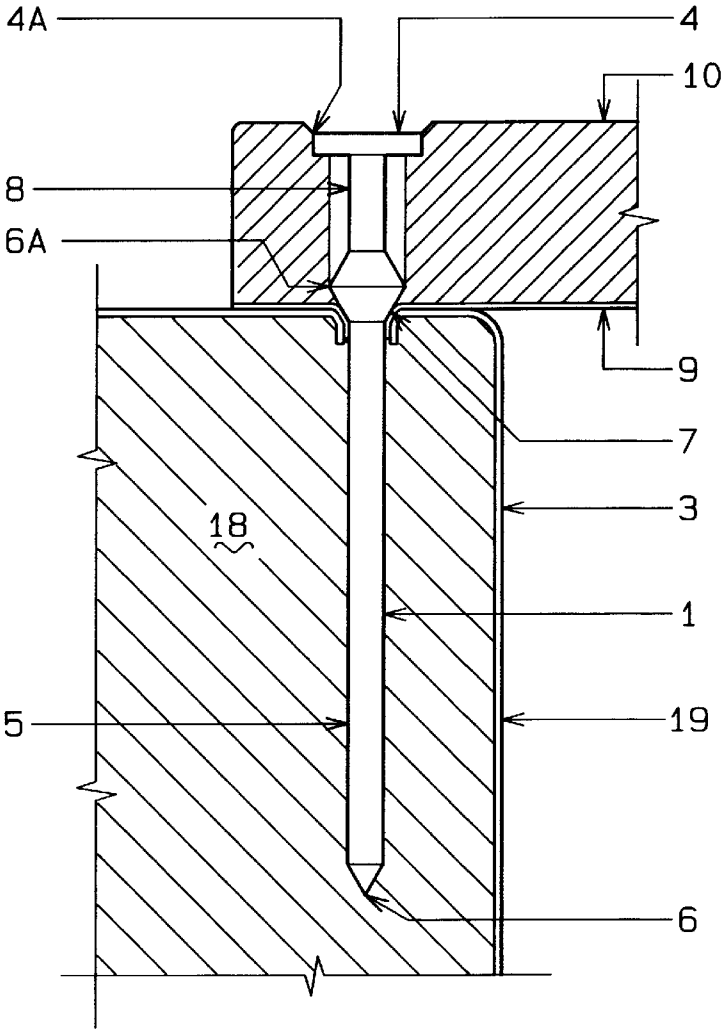
Figure 2C:
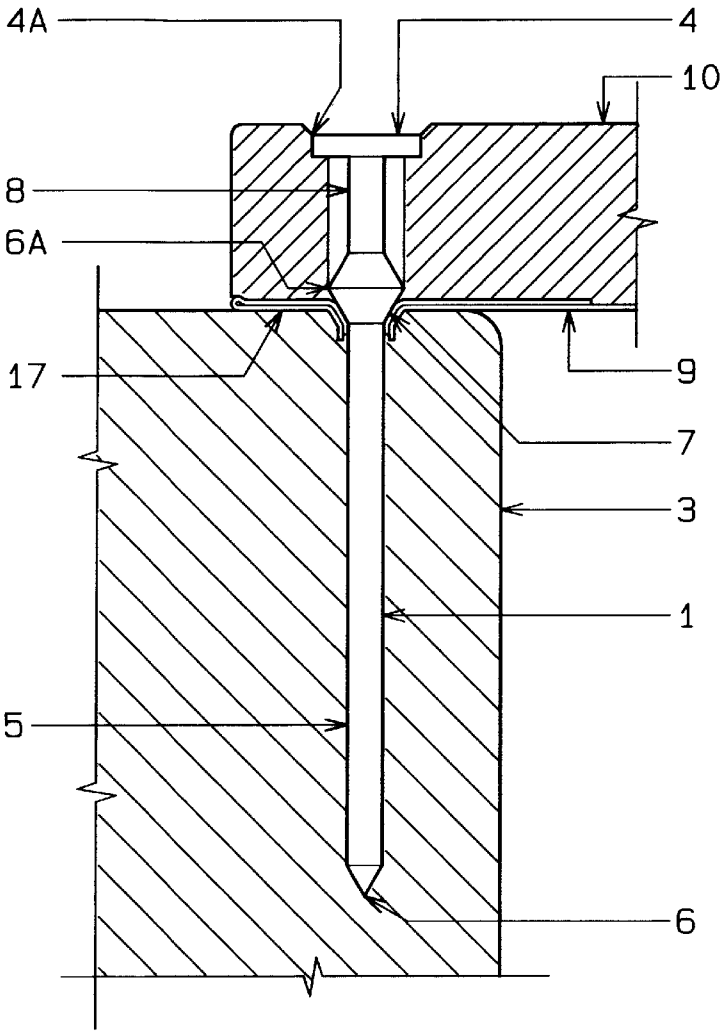

In FIG. 2C the structural membrane 9 is doubled along the edge 17 of the panel so as to reinforce the panel's tearout strength and ductility.

FIG. 2D shows a similar panel attachment to a composite framing member with a wood composite body portion 18 and a metal cladding 19.

Figure 2F:
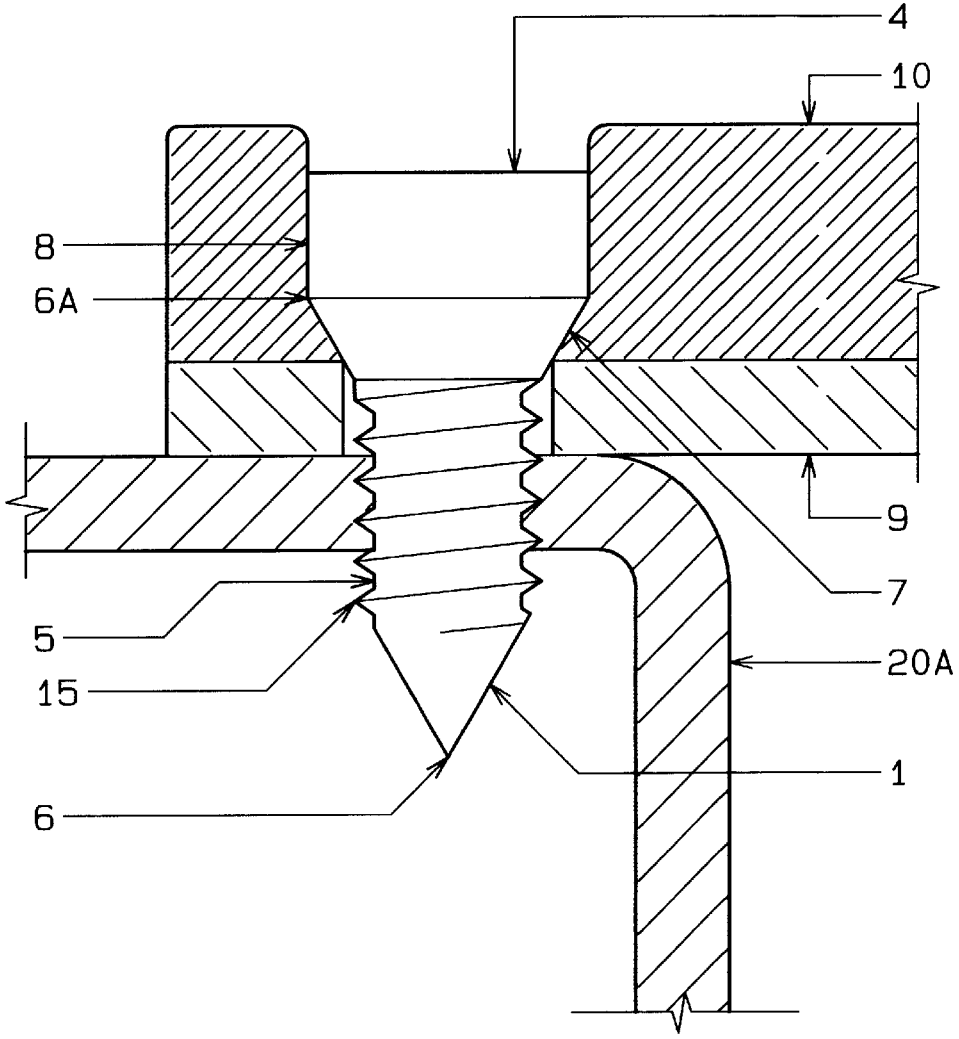
FIG. 2F shows a joint assembly in which the frame elements consist of heavy wall steel columns, the structural membrane is plate steel, and the fastener is a large diameter self tapping screw or bolt.
Figure 2E:
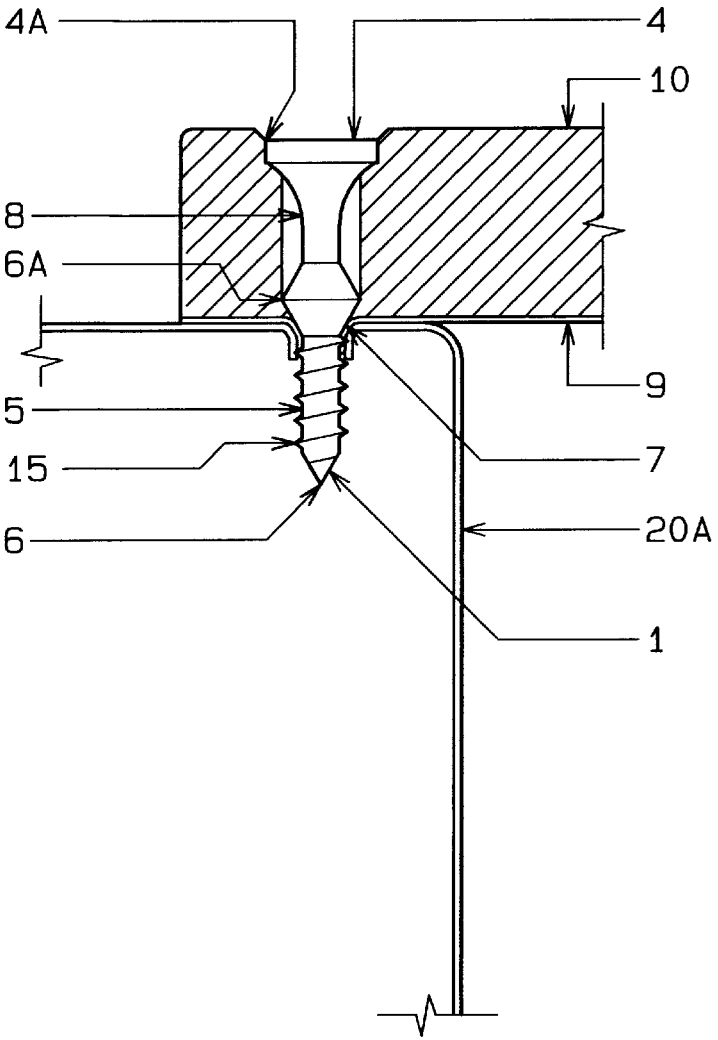

FIG. 2E shows a similar panel attachment to a typical hollow steel framing member 20. In this embodiment lower shaft section 5 has a metal screw thread 15 to secure the shaft to the sides of the hole formed in metal framing member 20.

In FIG. 2F joint assembly in which the frame element consist of a heavy wall steel column 20A, shown in cross-section, the structural membrane 9 is plate steel, and the fastener 1 is a large diameter self tapping screw or bolt with screw threads 15. In this embodiment, the upper shaft section 8 has a diameter equal to that of the shoulder 6A extending the entire distance from the bearing face 7 of shoulder 6A to head 4. The upper shaft thus entirely fills the hole in the lower tensile strength layer with its outer perimeter abutting against the wall of the hole. With this configuration, the wall of the hole will buttress upper shaft section 8 against lateral (bending) movement and thus the resistance of the fastener to bending due to shear forces is substantially increased.

Figures 3A, 3B, 3C, 3D, 3E, 5:
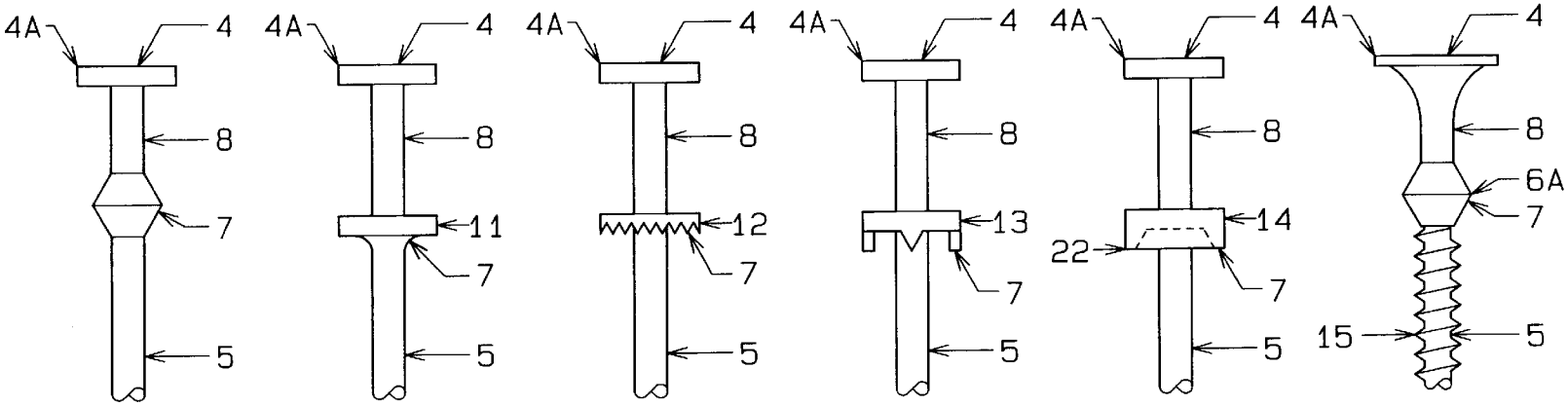
FIGS. 3A through 3E illustrate fasteners of this invention with various shoulder configurations as follows.
FIG. 5 illustrates a fastener of this invention with a shoulder configuration as shown in the nail embodiment of FIG. 3A, but with the lower nail portion replaced with a screw shaft.

Various other fastener shoulder configurations may be employed in the fasteners of this invention in addition to the fastener just described, and shown separately in FIG. 3A. For example, a radiused shoulder 11 may be employed as shown in FIG. 3B in which bearing face 7 has a radial profile. A shoulder 12 having a serrated bearing face 7, as shown in FIG. 3C, or a shoulder 13 having a bearing face 7 with brad points 21, as shown in FIG. 3D, may be employed in order to better grip the surface of the higher tensile strength membrane. In the embodiment of FIG. 3E shoulder 14 is provided with a downwardly pointing annular ring 22 so that the bottom edge thereof constitutes a bearing face 7 that will concentrate downward pressure at the ring against the higher tensile strength membrane.

As was described above in relation to FIG. 2F, it is advantageous to provide an enlarged upper section of the shaft in order to increase bending resistance of the shaft due to the increased proximity of the upper shaft to the wall of the hole created in driving the fastener and the lateral support provided thereby. Ideally, the upper shaft extends outwardly of the shaft axis the same distance as the shoulder from the head to the bearing face of the shoulder. However, at least some lateral support will result even if the enlargement extends only part of the distance between the head and the bearing face and if the upper shaft has a diameter at least two thirds of that of the maximum diameter of the shoulder. FIGS. 4A through 4E illustrate fasteners having enlarged upper shaft sections 8 with various types of shoulders and bearing faces.

Figures 4A, 4B, 4C, 4D, 4E, 6:
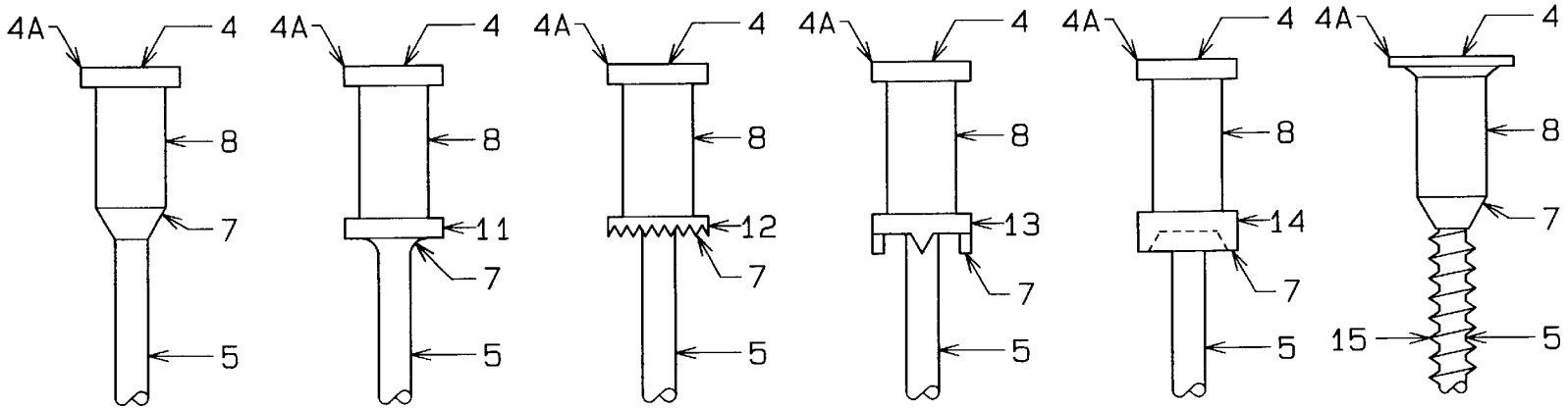
FIGS. 4A through 4E illustrate nails of this invention with various shoulder configurations and upper shafts of a different diameter than the lower shaft analogous to those shown in the nail embodiments of FIGS. 3A through 3E.
FIG. 6 illustrates a fastener of this invention with a shoulder and upper shaft configuration as shown in the nail embodiment of FIG. 4A, but with the lower nail portion replaced with a screw shaft.

As described above in relation to FIGS. 2E and 2F, the lower shaft of the fastener may be screw threaded as appropriate for metal, wood or other applications. FIG. 5 and FIG. 6 further illustrate fasteners bearing a thread 15, in these embodiments having the shoulder and upper shaft configuration of the fasteners of FIG. 2A and FIG. 3A, respecitively. Similar screw embodiments may be employed having the shoulder and upper shaft configurations of FIGS. 3B through 3E and FIGS. 4B through 4E.

Shear panels employed in this invention may be one inch or more thick but more typically will have a thickness between one quarter and three quarters of an inch. A fairly thin higher tensile strength membrane is usually desirable, with a thickness of above 0.01 inch and more typically above 0.02 inch. However, the membrane may be greater thickness of up to three eighths of an inch or greater. Higher thickness materials may require preboring of fastener holes in order to facilitate penetration of the fastener shaft, particularly in the case of steel sheets. The membrane may be a single layer or a laminate, with a steel sheet preferred. However, composites such as resin bonded carbon fiber or glass fiber may be employed. Also, for some applications a membane having a somewhat more moderate tensile strength may be usefully employed, together with a layer having less tensile strength. A preferred example is a structural grade water resistant fiberboard sheathing, composed of laminated fiberboard plies, as a higher strength membrane in a panel together with GWB as the lower tensile strength layer. Such fiberboard sheathing is available under the tradenames Thermoply, from Simplex, and Energy Brace, from Fiber-Lam Inc.

Advantageously, the shear panel edges can be reinforced, such as by folding back a margin of the membrane to form a double layer, which further strengthens the novel joints created by this invention.

The lower tensile sheet layer or facing may also be a single layer or a laminate, such as plywood, with the thickness varying from one eight inch up to one inch or higher. In the case of GWB the thickness is typically from about one quarter to five eighths inch. Other lower tensile strength materials may be employed such as wood, wood composites including OSB, plywood and the like, cement, plastic, or some other composite.

The length, width, and surface contours of the lower bearing face of the shoulder of the fastener are determined by the thickness and material properties of the higher tensile strength membrane so as to provide sufficient resistance against premature bearing, tearout, and pull through failures in the structural membrane under loading conditions. The diameter of the lower shaft of the fastener is less than the diameter of the shoulder so that the width of the puncture it produces in passing through the structural membrane is substantially smaller than the width of the shoulder. The length, width, and surface contours of the lower shaft are determined by the material properties of the frame so as to provide sufficient resistance against bending and withdrawal of the fastener without excessive damage to the members of the structural frame. For example, the lower shaft of the fastener can be thicker or thinner, straight or ring-shanked.

The fastener, which can be a be a nail or a screw, can be installed as loose pieces or collated for installation by nail-gun or screw-gun. The entire system can be scaled up for use in taller, more highly loaded building by using plate steel structural membranes, bolted joints, and concrete or steel I-beam framing members The size and strength of the fastener and the membrane are selected so as to form a flexible, ductile, connection with reliable elastic and inelastic deformation and failure properties. Under load it is desirable to create ductile deformations in the fastener and higher strength membrane so as to maximize movement of the connection while minimizing damage to the frame and structure. By taking fully advantage of the energy absorption ability of the connections a large amount of hysteric damping is created within the structure under transient loading conditions which has the highly desirable result of reducing the loads throughout the structure.

From an examination of the various embodiments, a number of advantages of my structural system become evident:

(a) Shear forces in the plane of the panel are transmitted to the fastener through the membrane 9 at the fastener's shoulder bearing surface 7 which minimizes bending load on the fastener shaft.

(b) Out-of-plane loads on the connection such as seismic loads or membrane buckling forces are resisted by the inner face of the fastener shoulder bearing directly against the membrane (c) By reducing bending, fatigue, and pullout loads on the fastener a smaller diameter shaft can be employed thus reducing splitting in the framing and allowing the use of more closely spaced fasteners to attach the shear panel to the frame and thus increasing the strength of the assembly.

(d) Correct fastener installation is facilitated by the installer's ability to feel the fastener as it passes through the membrane and into the framing member and to correctly gauge the proper depth of insertion by observing the flushness of the fastener head relative to the finished surface of the shear panel (f) Structural inspection of the installed panel is facilitated by allowing the final installation of shear walls to occur after other trades have completed their installations inside the walls.

(g) The strength of membrane/shouldered fastener connection is more uniform than other shear diaphragms (such as an assembly of OSB and ordinary nails) and consequently structures can be designed and constructed with a greater degree of confidence and reliability.

In applying this invention to typical building construction, the building's framing members are erected and the building is then fitted with the required structural, mechanical, electrical, plumbing, and other operating systems in the customary manner. The wall's shear panels are temporarily omitted allowing optimum access for the construction, inspection, and any correction of these systems to be performed. These operations are well known to those versed in building construction and need not be described in detail herein.

The shear panel/fastener system described herein is then installed in the customary manner with fasteners spaced along the edges of the panel and within the field of the panel in accordance with the requirements of the building's drawings and structural analysis. The structural integrity of the shear panel joints can then be inspected and approved. The building can then be completed in the normal manner.

By postponing the installation of the shear panels/fasteners until after the other trades have completed their work several, highly desirable, advantages are obtained:

(a) All tradesmen can have clear access to the frame in order to more easily accomplish their work.

(b) Inspection of the work inside the frame is easier and more thorough without the shear panels in place.

(c) The structural inspector can be more confident that subsequent tradesmen will not need to cut unauthorized access holes in the shear panels to accomplish their work and thus weaken the shear panels in a manner unbeknownst to the structural engineer.

(d) By reducing the need for unanticipated holes in the shear panels the cost of inspecting and/or performing structural repairs on such holes is greatly reduced.

By eliminating the need for a separate layer of finish material to be applied over the shear panels several, highly desirable, advantages are obtained:

(a) Construction costs are significantly reduced by the elimination of the second, finish, layer of gypsum wall board.

(b) All interior walls can be a uniform thickness; eliminating the need to add shims or additional layers of material to compensate for the layer of structural OSB or plywood in conventional construction. All interior door jambs can be ordered at the same width rather than one set for shear walls and a different set for ordinary walls.

(c) The structural shear panel/fasteners are readily accessible for future structural modification should the need arise for upgrade, inspection, or repair such as in the case of earthquake damage.

Although the description above contains many specificities, these should not be construed as limiting the scope of the invention but as merely providing some of the presently preferred embodiments of the invention.

I claim:

1. A joint between a first element of a structure comprised of a laminar material comprising a membrane layer having higher tensile strength and a second layer having substantially lower tensile strength and a second element of the structure, at opposed and generally abutting surfaces of the elements with the membrane layer of the first element being between the second layer thereof and the second element, secured by at least one fastener comprising a shaft having a point end and a head end, a head at the head end and a shoulder intermediate the ends with a bearing face generally in the direction of the point end to provide a seating location, the point end of the fastener being driven into the laminar material at the surface of the side remote from the second element, through the first element and into the second element at the abutting surfaces to a location where the bearing face of the shoulder seats against the second layer of the first element, thereby to directly engage the second layer against movement both parallel and normal to the first element.

2. A joint as in claim 1 and wherein the distance along the shaft between the top of the head of the fastener and the seating location of the bearing face of the shoulder is about equal to or greater than the distance through the laminar material from the surface of the side remote from the second element to the second layer, so that the head of the fastener may be easily engaged to drive the fastener into the position where the bearing face of the shoulder of the fastener engages the second layer of the laminar material.

3. A joint as in claim 1 and wherein the distance along the shaft between the top of the head of the fastener and the seating location of the bearing face of the shoulder is about equal to the distance through the laminar material from the surface of the side remote from the second element to the second layer, so that the proper distance for driving the fastener into the position where the bearing face of the shoulder of the fastener engages the second layer of the laminar material may be easily gauged and the head of the fastener will not protrude from the surface of the laminar material after it is driven into place.

4. A joint as in claim 3 and wherein the head of the fastener has a rim which extends farther outwardly in the direction normal to the axis than does the shaft over the portion of the shaft between the head and the bearing face of the shoulder, to thereby engage the face of the laminar material.

5. A joint as in claim 4 and wherein the thickness of the membrane layer is between about 2/100th and 3/8th of an inch and the thickness of the second layer is between about 1/4th of an inch and 1 inch.

6. A joint as in claim 5 and wherein the membrane layer comprises sheet metal and the second layer comprises GWB.

7. A joint as in claim 1 and wherein the shaft is generally cylindrical and the bearing face of the shoulder is annular and concentric with the shaft.

8. A joint as in claim 7 and wherein the head of the fastener has a rim concentric with the shaft with an outer diameter greater than the largest diameter of the shaft between the head and the seating location of the bearing face of the shoulder, to thereby engage the face of the laminar material.

9. A joint as in claim 7 and wherein the bearing face of the shoulder is generally frusto-conical with the apex direction toward the point end of the shaft and the seating location of the bearing face against the membrane layer is at an intermediate position along the bearing face, whereby the bearing face wedges out an expanded hole in the second layer to thereby increase the tear-out strength of the joint.

10. A joint as in claim 7 and wherein the diameter of the shaft over at least a portion of the distance from the head toward the bearing face of the shoulder is about the same diameter as the maximum diameter of the shoulder, whereby the shaft above the shoulder will engage the sides of the opening created by driving of the fastener through the laminar material when the fastener is subjected to bending moments caused by shear stresses to the joint.

11. A joint as in claim 10 and wherein the diameter of the shaft over substantially the distance from the head toward the bearing face of the shoulder is about the same diameter as the maximum diameter of the shoulder.

12. A joint as in claim 7 and wherein the bearing face of the shoulder extends outwardly of the shaft about the longitudinal axis thereof a distance equal to at least 10% of the diameter of the shaft adjacent the bearing face.

13. A joint as in claim 12 and wherein the bearing face of the shoulder extends outwardly of the shaft about the longitudinal axis thereof a distance equal to between about 25 to 200% of the diameter of the shaft adjacent the bearing face.

14. A panel structure comprising a shear panel and supports for the shear panel, the shear panel comprised of a membrane layer having substantial tensile strength, and a second layer having substantially lower tensile strength and being joined to the supports at each of a plurality of spaced apart locations by a joint as described in claim 1.

15. A panel structure comprising a shear panel and supports for the shear panel, the shear panel comprised of a membrane layer having substantial tensile strength, and a second layer having substantially lower tensile strength and being joined to the supports at each of a plurality of spaced apart locations by a joint as described in claim 3.

16. A panel structure as in claim 15 and wherein the panel structure supports at the joints are wooden framing elements.

17. A panel structure as in claim 15 and wherein the membrane layer comprises sheet metal and the second layer comprises a wood composite.

18. A panel structure as in claim 15 and wherein the membrane layer comprises a fiberboard laminate and the second layer comprises GWB.

19. A unitary panel structure comprising two opposed shear panels supported by and fastened to framing elements interposed therebetween, each shear panel comprised of a membrane layer adjacent the framing elements having substantial tensile strength, and a second layer outwardly of the membrane from the framing elements having substantially lower tensile strength and each shear panel being joined to the elements at each of a plurality of spaced apart locations by a joint as described in claim 3.

20. A panel structure comprising a shear panel and supports for the shear panel, the shear panel comprised of a membrane layer having substantial tensile strength, and a second layer having substantially lower tensile strength and being joined to the supports at each of a plurality of spaced apart locations by a joint as described in claim 9.

21. A method of securing a first element of a structure comprised of a laminar material comprising a membrane layer having higher tensile strength and a second layer having substantially lower tensile strength from movement in a plane parallel with the first element of the structure which comprises providing at least one fastener comprising a shaft having a point end and a head end, a head at the head end and a shoulder intermediate the ends with a bearing face facing in the direction of the point end and driving the point end of the fastener into the side of the first element remote from the membrane layer thereof, through the first element, into a second element of the structure in abutment with the first element at the side of the first element remote from the second layer and to a seating location where the bearing face of the fastener shoulder bears against the second layer of the first element.

22. A method as in claim 21 wherein the head of the fastener has a rim which extends farther outwardly in the direction normal to the axis than the shaft extends outwardly thereof over the portion of the shaft between the head and the bearing face of the shoulder, to thereby engage the face of the laminar material, and wherein the distance along the shaft between the top of the head of the fastener and the seating location of the bearing face of the shoulder is about equal to the distance through the laminar material from the surface of the side remote from the second element to the second layer, so that the proper distance for driving the fastener into the position where the bearing face of the shoulder of the fastener engages the second layer of the laminar material may be easily gauged and the head of the fastener will not protrude from the surface of the laminar material after it is driven.

23. A method as in claim 21 wherein the bearing face of the shoulder is annular, concentric with the shaft and generally frusto-conical with the apex direction toward the point end of the shaft and wherein the seating location of the bearing face against the membrane layer is at an intermediate position along the bearing face, whereby the bearing face wedges out an expanded hole in the second layer to thereby increase the tear-out strength of the joint.

* * * * *